US007481014B2

(12) United States Patent
Milburn

(10) Patent No.: US 7,481,014 B2
(45) Date of Patent: Jan. 27, 2009

(54) DECORATIVE WALL MOUNTED STORAGE CONTAINER

(76) Inventor: Samatha Milburn, 245 11th Ave., NE., St. Petersburg, FL (US) 33701

( * ) Notice: Subject to any disclaimer, the term of this patent is extended or adjusted under 35 U.S.C. 154(b) by 58 days.

(21) Appl. No.: 11/544,444

(22) Filed: Oct. 8, 2006

(65) Prior Publication Data

US 2007/0114894 A1 May 24, 2007

Related U.S. Application Data

(60) Provisional application No. 60/730,437, filed on Oct. 26, 2005.

(51) Int. Cl.
*A47G 1/06* (2006.01)

(52) U.S. Cl. ..... 40/724; 312/245; 312/315

(58) Field of Classification Search ..... 40/724; 312/245, 313, 315, 281, 282
See application file for complete search history.

(56) References Cited

U.S. PATENT DOCUMENTS

| | | | | | |
|---|---|---|---|---|---|
| 132,632 | A * | 10/1872 | Cogswell | 312/232 |
| 191,795 | A | 6/1877 | Bowers et al. | |
| 279,290 | A | 6/1883 | Von Der Wulbeke | |
| 407,588 | A * | 7/1889 | Gorham | 312/234 |
| 1,038,332 | A * | 9/1912 | Fanning | 312/230 |
| 1,428,957 | A * | 9/1922 | Hall | 312/315 |
| 1,882,157 | A | 10/1932 | Minton | |
| 2,275,373 | A * | 3/1942 | Barrett | 312/300 |
| 2,589,641 | A | 3/1952 | Stewart | |
| 3,214,032 | A * | 10/1965 | Hightower | 211/99 |
| 3,515,450 | A * | 6/1970 | Jaecke | 312/245 |
| 4,186,833 | A | 2/1980 | Homan | |
| 4,304,447 | A * | 12/1981 | Ellwood et al. | 312/204 |
| 5,251,759 | A | 10/1993 | Gannon et al. | |
| 5,373,654 | A | 12/1994 | Whalen | |
| 6,006,502 | A | 12/1999 | Smith | |
| 6,039,416 | A * | 3/2000 | Lambert | 312/245 |
| 6,113,202 | A * | 9/2000 | Germano | 312/245 |
| 6,123,197 | A | 9/2000 | Marquez et al. | |
| 6,266,942 | B1 | 7/2001 | McClorey | |
| 6,349,494 | B1 | 2/2002 | Haggarty-Robbins | |
| 7,044,178 | B1 * | 5/2006 | Campbell | 144/285 |

* cited by examiner

*Primary Examiner*—Gary C Hoge
(74) *Attorney, Agent, or Firm*—Holland & Knight LLP

(57) ABSTRACT

Disclosed is a decorative wall mounted container system. The system includes a container with an opened front and a pivotal forward cover. The cover has both a closed orientation, overlying the opened front of the container and an opened orientation. The front face of the cover can take the form of a decorative picture, which is displayed when the cover is in the closed orientation. In the opened configuration, the cover is retained at a 90-degree angle relative to the container, such that the rearward face of the cover can be used as a work surface and the contents of the container can be accessed.

1 Claim, 5 Drawing Sheets

FIG 1
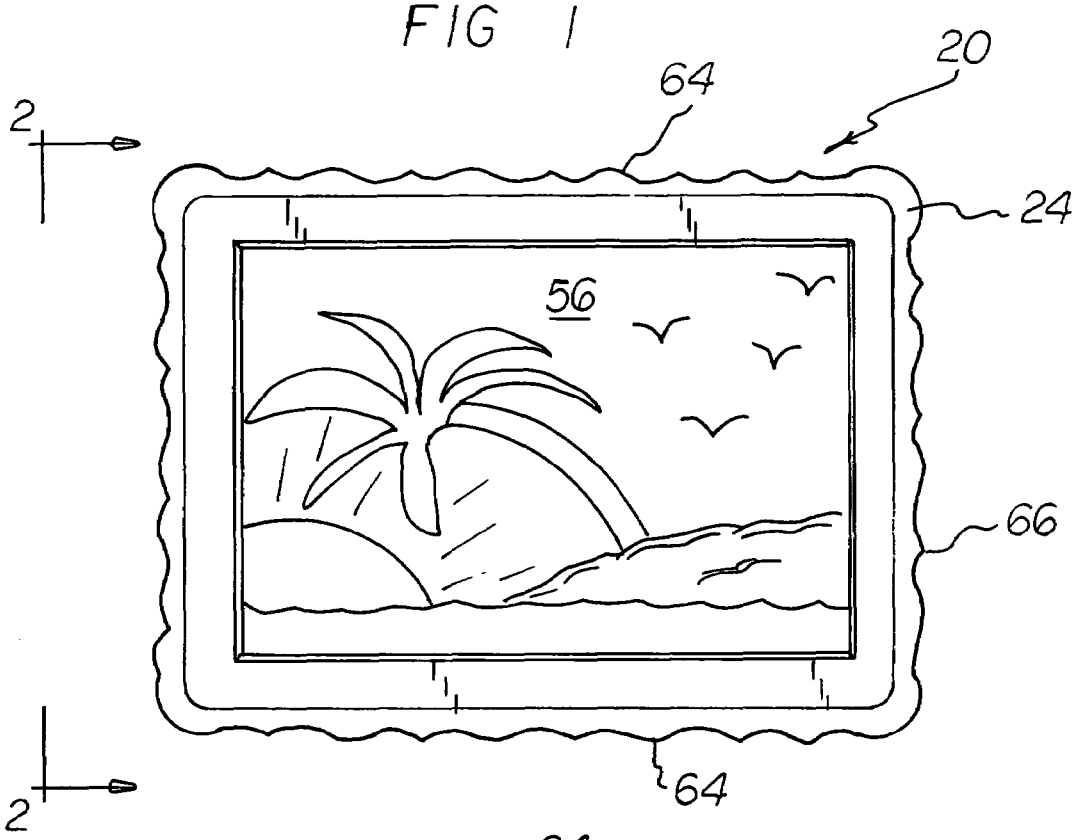
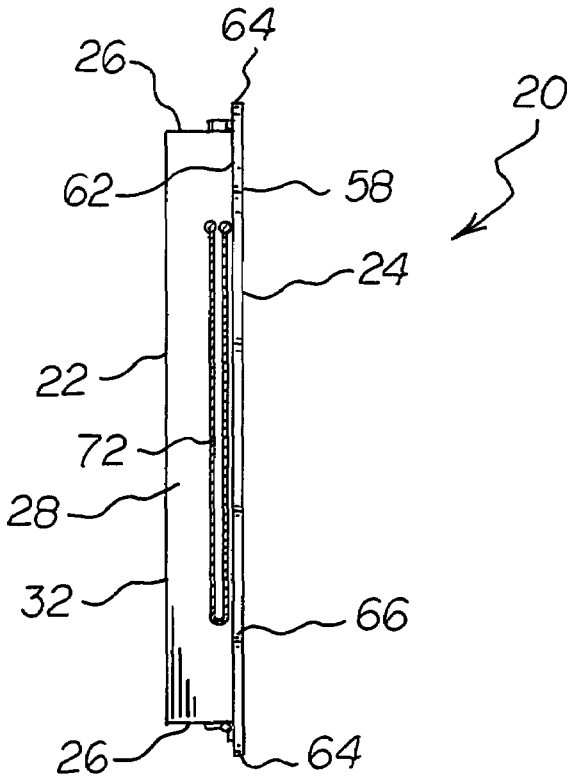
FIG 2

FIG 3
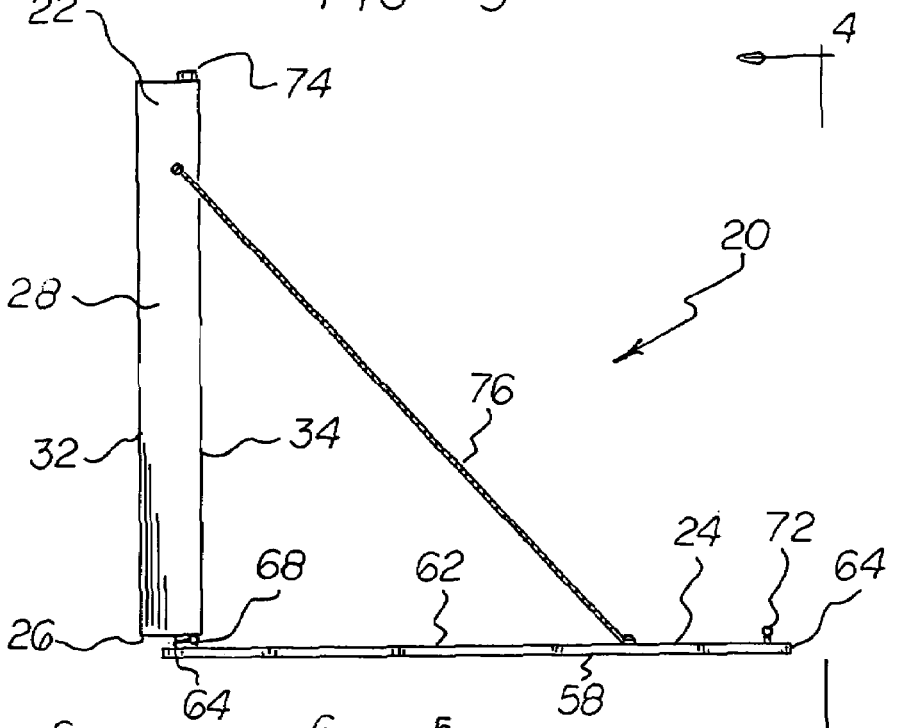
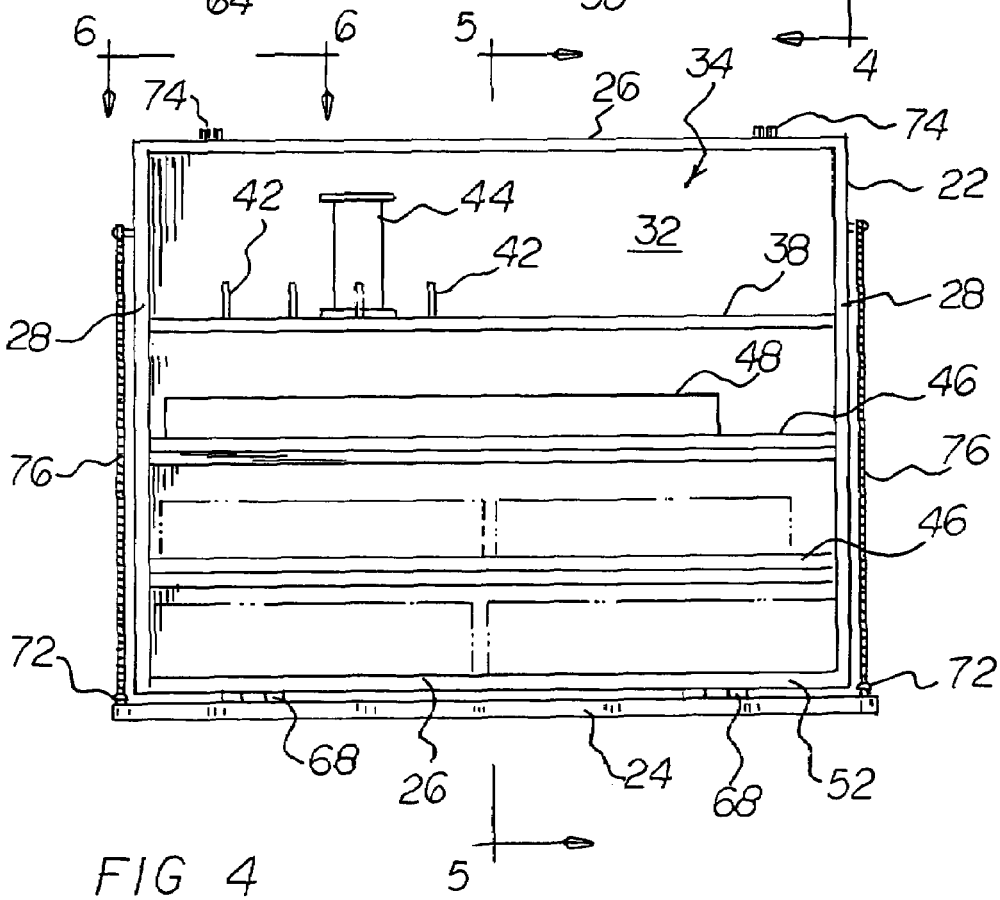
FIG 4

FIG 9
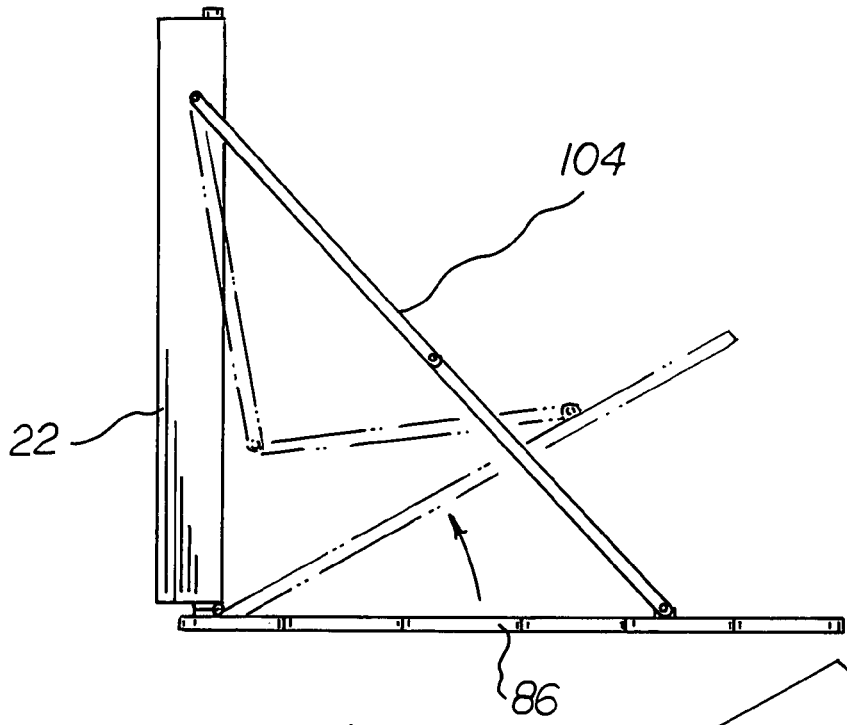
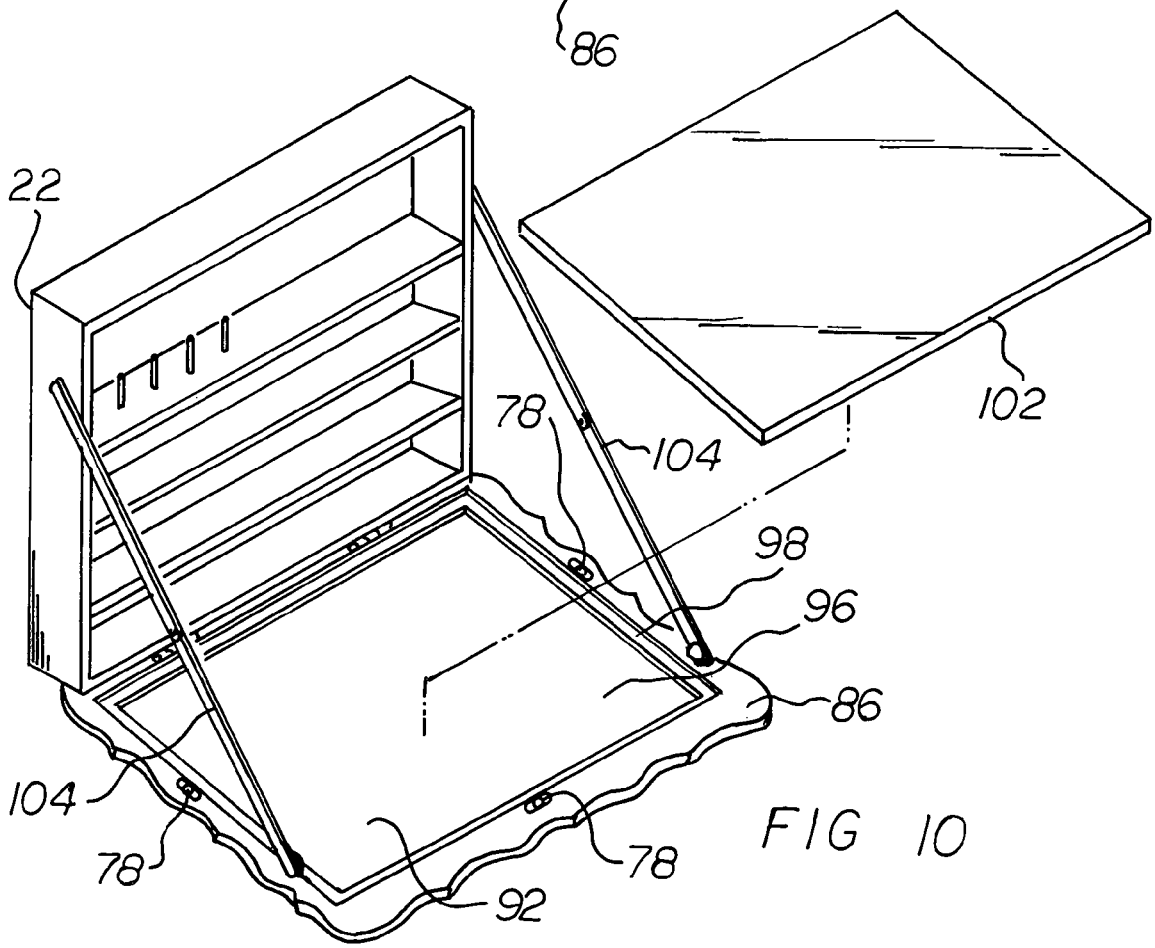
FIG 10

DECORATIVE WALL MOUNTED STORAGE CONTAINER

DESCRIPTION OF RELATED APPLICATIONS

This application claims benefit from provisional application Ser. No. 60/730,437 filed on Oct. 26, 2005, the contents of which are incorporated herein by reference.

BACKGROUND OF THE INVENTION

1. Field of the Invention

This invention relates to a wall mounted storage container; more particularly, the invention relates to a container that takes on a decorative appearance in its closed configuration and which provides for a work surface in its opened configuration.

2. Description of the Background Art

Presently, picture frames that include enclosed compartments are known in the art. For instance, U.S. Pat. No. 5,373,654 to Whalen discloses a corner picture frame comprising an enclosed triangular compartment. The picture is mounted upon, and forms a portion of, the outer, rectangular closure. The enclosure includes a hollow interior with one or more triangular shelves. Hinges are included on one side of the closure to enable pivotal movement of the picture.

Furthermore, U.S. Pat. No. 191,795 to Bowers and Murphy discloses a picture frame that is intended to be suspended against a wall and that is combined with a writing desk. When used as a writing desk, the frame is drawn down to the desired height. The front of the device is then opened forward on hinges. The front is secured by side braces. Likewise, U.S. Pat. No. 279,290 to Von Der Wulbeke discloses a table that when not in use can be swung upward and held in place against a wall, whereby it can serve as a picture, mirror or other ornament.

Finally, it is also known in the art to use storage containers for gift-wrapping supplies. For example, U.S. Pat. No. 6,123,197 to Marquez discloses a storage container for holding wrapping paper and gift-wrapping accessories. The container is adapted to vertically receive rolls of wrapping paper. Internal receptacles are also included at an inclined configuration within the interior of the container.

Although each of the above-referenced inventions achieves its individual objective, they all suffer from common drawbacks. The decorative wall mounted storage container of the present invention is aimed at overcoming the drawbacks associated with these prior art devices.

SUMMARY OF THE INVENTION

It is therefore one of the objectives of this invention to provide a wall mounted storage container with both an opened and closed configuration.

It is a further object of this invention to provide a storage container wherein in the closed configuration it takes the appearance of a decorative picture and the opened configuration it forms a suitable work surface.

It is also an object of this invention to provide a wall mounted container system that is specifically adapted to hold wrapping paper supplies and, therefore, includes inclined shelving to securely store rolls of wrapping paper.

Still another object of this invention is to provide a wall mounted container system that is combined with a picture and picture frame and wherein the picture can be easily removed and replaced such that a user can use various decorative pictures in conjunction with the container system.

The foregoing has outlined rather broadly the more pertinent and important features of the present invention in order that the detailed description of the invention that follows may be better understood so that the present contribution to the art can be more fully appreciated. Additional features of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a front elevational view of the storage container system of the present invention.

FIG. 2 is a side view of the storage container system of the present invention taken along Line 2-2 of FIG. 1.

FIG. 3 is a side elevational view of the storage container system in its opened configuration.

FIG. 4 is a front elevational view of the storage container system in its opened configuration taken along Line 4-4 of FIG. 3.

FIG. 9 is a side elevational view of the alternative embodiment of the container system wherein articulated linkages are disclosed for bracing the sides of the container.

FIG. 10 is a partially exploded view of the alternative embodiment of the container system wherein a rigid backing member is placed into the picture frame behind the picture.

Similar reference characters refer to similar parts throughout the several views of the drawings.

DETAILED DESCRIPTION OF THE PREFERRED EMBODIMENT

The present invention relates to a decorative wall mounted container system. The system includes a container with an opened front and a pivotal forward cover. The cover has both a closed orientation, overlying the opened front of the container and an opened orientation. The front face of the cover can take the form of a decorative picture, which is displayed when the cover is in the closed orientation. In the opened configuration, the cover is retained at a 90-degree angle relative to the container, such that the rearward face of the cover can be used as a work surface and the contents of the container can be accessed. The various details of the present invention, and the manner in which they interrelate, will be described in greater detail hereinafter.

Figure 5:
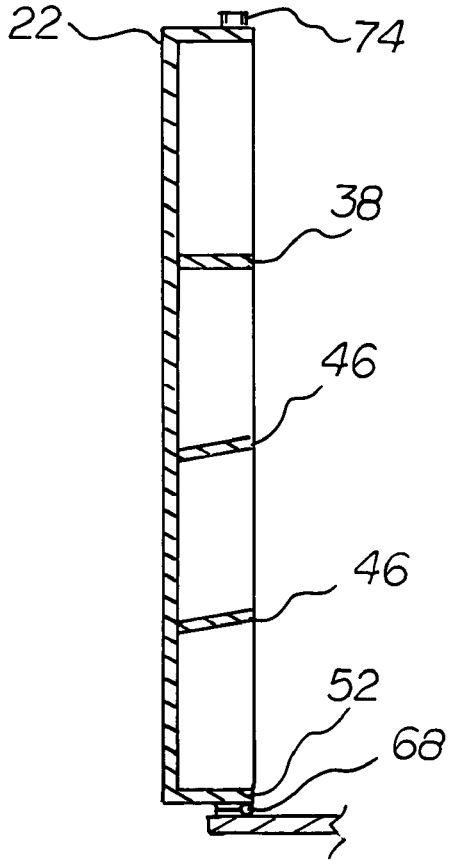
FIG. 5 is a side sectional view of the container system of the present invention taken along Line 5-5 of FIG. 4.
Figure 6:
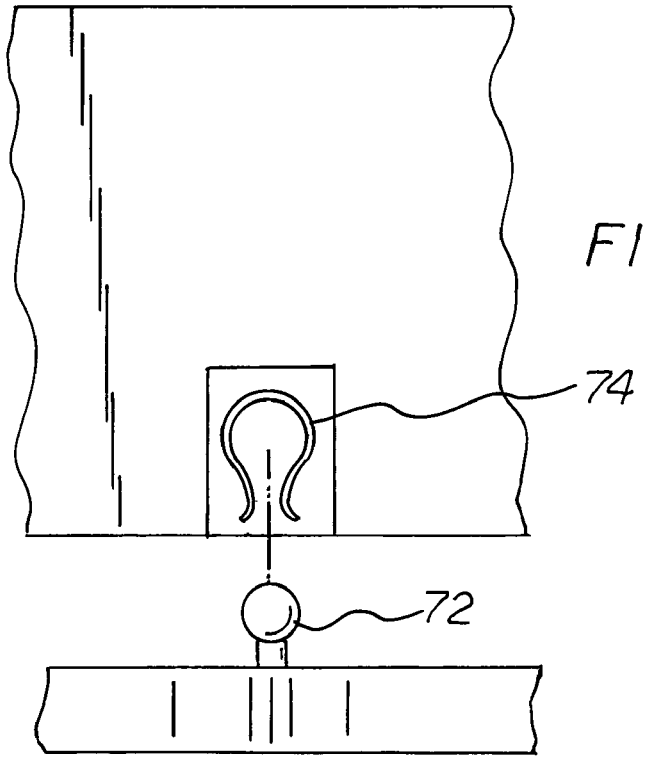
FIG. 6 is a detailed view of the male and female latches employed upon the container and is taken along Line 6-6 of the FIG. 4.
Figure 7:
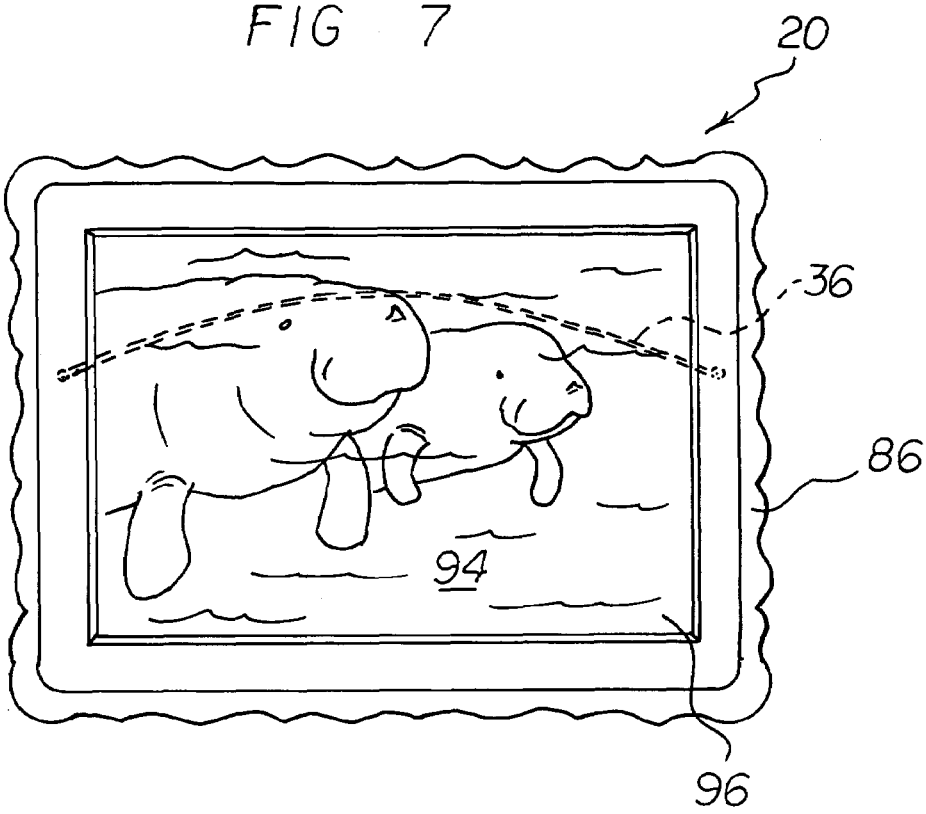
FIG. 7 is front elevational view of an alternative container system of the present invention with a picture frame hanger illustrated in phantom.

With reference now to FIGS. 1-6, the container system 20 of the primary embodiment is illustrated. As noted in FIG. 2, system 20 consists of both a container 22 and an associated cover or frame 24. In the preferred embodiment, container 22 is rectangular, vertically oriented and mounted upon a wall. As further noted in FIG. 4, container 22 includes an interior area bounded by upper and lower edges 26, sidewalls 28 and a closed rearward face 32. The container further includes an opened forward face 34 whereby a user can gain access to the interior of container 22. Rearward face 32 can be secured to a wall via a hanging wire 36 (note FIG. 7) in a manner similar to the way one would hand a conventional picture frame.

In the preferred embodiment, container 22 has a depth of between 3 to 8 inches, a height of between 24 and 36 inches and a width of between 30 to 44 inches. It has been discovered that these dimensions provide for optimal storage capacity, but at the same time do not provide for an overly bulky or obtrusive structure when mounted upon a wall. Of course, the use of containers with varying dimensions and shapes is within the scope of the present invention.

A series of shelves are ideally included within container 22 to facilitate the convenient storage of a wide variety of items. The shelves can be horizontally arranged in a conventional configuration, or they can be positioned at right angles to each other to form a series of smaller individual compartments. Alternatively, individual compartments can be formed via a series of internal drawers or doors. It is within the scope of the present invention to use any number of shelves to better maximize storage within the interior of the container. It is also within the scope of the present invention to not include any drawers at all, leaving the entire container free for the storage of supplies. In such an embodiment, a series of elongated dowels can be secured to the bottom of container 22 to support long rolls of wrapping paper within the container.

However, in the preferred embodiment, three different shelves are positioned between the sidewalls 28 of container 22 (FIG. 4). The first uppermost shelf 38 is horizontally oriented. If container 22 is used for the storage of wrapping paper supplies, for instance, this shelf can be used to store scissors, glue, string, bows or other such supplies. In the preferred embodiment, a number of vertically oriented dowels 42 are included along the uppermost shelf 38, although the use of fewer or more dowels is within the scope of the present invention. Each dowel 42 is positioned within the axis of a spool 44, such as a spool of ribbon or string, thereby supporting spool 44 in a vertical orientation. Dowels 42 thus enable material to be dispensed without the need to remove the associated spool 44 from the interior of container 22. In the embodiment depicted in FIG. 4, four such dowels 42 are included.

FIG. 4 also illustrates the two lower inclined shelves 46. Unlike the uppermost shelf 38, these shelves 46 are inclined rearwardly; namely the shelves slope downwardly towards rear face 32 of container 22. However, it is within the scope of the present invention to make all of the shelves either inclined or horizontal. The inclination of the shelves is best illustrated in the cross section of FIG. 5. The inclination allows the shelves to securely store cylindrical object, such as paper rolls or wrapping paper 48. As with the uppermost shelf, these inclined shelves 46 extend fully between, and are supported by, the two opposing sidewalls 28 of container 22. Due to the rearward inclination, the wrapping paper rolls 48 are prevented from rolling out of container 22 when cover 24 is opened. Finally, the lower edge of the container 52 provides an additional horizontal shelf for the storage of additional supplies.

Figure 8:
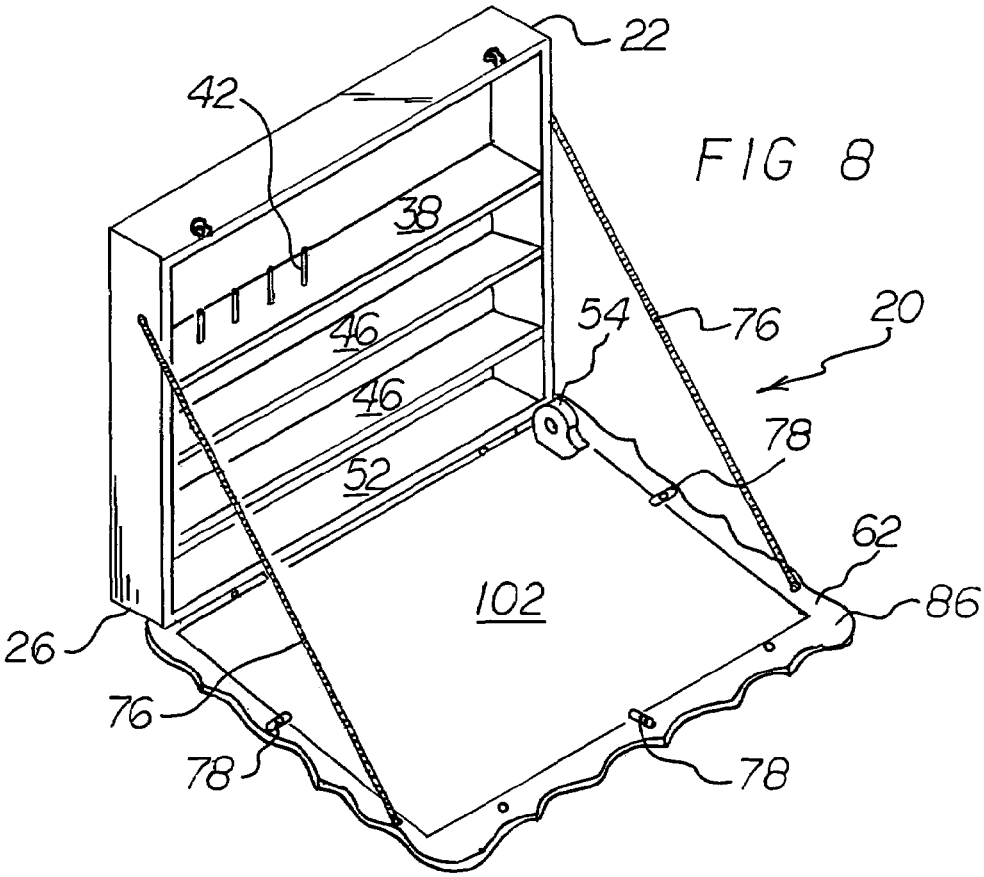
FIG. 8 is a perspective view of an alternative container system of the present invention shown in the opened configuration.

A conventional tape holder 54 can also be secured to the working surface of the frame (Note FIG. 8). The tape holder would be positioned such that when the frame was pivoted into its closed orientation, the tape holder would be positioned intermediate two adjacent shelves. This could be accomplished by adhesively securing the dispenser to an appropriate location upon rear face 62 of the cover 24.

Frame 24 depicted in the embodiment of FIGS. 1 through 6 is integrated, in that it incorporates a picture 56 on an outer face 58 and a surrounding frame (note FIG. 1). Thus, this embodiment does not allow for picture 56 or frame to be replaced. Frame 24 is defined by front or outer face 58 and a rear face 62. Frame 24 is also defined by upper and lower edges 64 and peripheral side edges 66. A number of hinges 68 are provided to pivotally interconnected to the lower edge 64 of frame 54 to the lower edge 26 of container 22 (note FIG. 3). In the preferred embodiment, two such hinges are included, although any number of hinges can also be employed in the present invention. By way of hinges 68, frame 24 can be selectively positioned in either a closed or an opened orientation. In the closed orientation, as noted in FIG. 2, frame 24 overlies the opened forward face 34 of container 22. In the opened orientation, as noted in FIG. 3, frame 24 is positioned at a 90-degree angle relative to container 22.

In order to facilitate the positioning of the frame in the opened orientation, the container system includes two braces 76 (note FIG. 3). In the preferred embodiment, braces 76 take the form of two link chains. However, it is within the scope of the present invention to similarly use cables, ropes or wires for the braces. Each chain 76 is interconnected between an upper extent of a container sidewall 28 and an upper extent of a peripheral edge of frame 24. Ideally, chains 76 are long enough to limit the pivotal movement of frame 24. In other words, once frame 24 reaches a position that is 90 degrees relative to the opened face 34 of container 22, chains 76 become taut and limit further movement. This orientation allows users to access the interior shelves of container 22 but at the same time allows rear face 62 of frame 24 to be used as a work surface. Furthermore, while the frame is being used as a work surface, chains 76 serve to brace the entire container system 20 and thereby provide a sufficient degree of rigidity.

Frame 24 is maintained in the closed orientation via mating latch members 72-74. Namely, two female latch members 74 are included along the upper edge 26 of container 22 and two male latch 72 members are included at corresponding positions along the rear face 62 of frame 24 (note FIG. 6). The depicted latch members 72-74 are friction catches, whereby a sufficient degree of force is required to either engage or disengage the male and female elements (72 and 74 respectively). Although a friction catch is preferred, a variety of latching members can be utilized, such as an elbow, roller, or magnetic catches. The only requirement is that the frame can be positively retained in the closed orientation when a user so desires.

A multipart frame 86 is illustrated in the embodiment of the invention depicted in FIGS. 7 through 10. Unlike the embodiment of FIG. 1-6, this embodiment allows the picture to be replaced. As with the primary embodiment, frame 86 is interconnected to the lower edge 26 of container 22 by way of hinges 68. As depicted in FIG. 8, a series of pivotal latches 78 are included around the periphery of frame 86 at the rear face 62. Frame 86 further includes an opened front face 92 through which a picture 94 can be displayed. The front face 92 is preferably protected by a transparent pane of glass or plastic 96. An interior stepped edge 98 may also be included that is dimensioned to receive the picture 94 to be displayed.

Thus, a user can select a picture 94 of a suitable size, either matted or non-matted, and place it within the stepped edge 98 of frame 86. This allows the picture 94 to be viewed through the open front face 92 and through the glass or plastic 96. With picture 94 so positioned, a rigid backing 102 can be positioned upon the back of the picture 94 by placing it within the stepped peripheral edge 98 of frame 86. Thereafter, the rotatable latches 78 can be closed to secure both the picture 94 and rigid backing 102 to the frame 86. This arrangement allows the frame container system 20 to be used in conjunction with any number of suitably sized pictures. Furthermore, when frame 86 is in its opened configuration (note FIGS. 8 and 10), the rigid backing 102 functions as a suitable horizontal work surface.

FIGS. 9 and 10 also disclose an alternative embodiment wherein the bracing members are formed from two-bar linkages 104. Namely, when the frame is in the closed configuration, the two-bar linkages 104 folds in upon themselves about a pivot point. Conversely, when the frame is opened, the two-bar linkages 104 are extended and serve to brace the sides of the container system.

As noted above, when frame 86 is in its opened configuration, the rear surface 62 of frame 86 serves as a suitable work surface. The rear surface 62 can also include grooves to make it easier for a user to cut wrapping paper that is lying flat upon surface 62. Guide lines and rulers can also be included upon surface 62. In this configuration, a user has access to all of the interior shelving, including any retained spools of ribbon. This gives a user ready access to any of the supplies normally needed to wrap gifts, such as scissors or tape. In the closed orientation, the container system would take on the appearance of wall-mounted artwork. Due to the relatively narrow depth of container 22, passer-by would not recognize the invention as a container system 20.

Container system 20 is designed to be hung on a wall via a hanging wire 36. Although a wire is disclosed in the preferred embodiment, the system can also be hung by drilling it into the wall or via heavy duty picture hangers. Any device used to hang large pictures can potentially be used to support the container of the present invention. The position of container system 20 upon the wall will depend upon its intended manner of use. For example, system 20 can be hung higher upon a wall if it is intended for use by a user who wishes to use it while standing. If frame 86 is to be used as a writing desk, system 20 would be hung at a lower orientation. The hanging height can also be varied depending upon the height of the intended user. Additionally, container system 20 can be fitted into a recessed portion within a wall. This would allow the frame to lie flush against a wall.

It is within the scope of the present invention to provide the container system in a wide variety of sizes and dimensions. It is further within the scope of the present invention to construct the system from any of a wide variety of suitable materials, such as wood, metal or injection molded plastic.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A wall mounted container system for the storage of gift-wrapping supplies comprising:

a vertically oriented wall mounted container having upper and lower edges and peripheral sidewalls there between, the container further including a closed rearward face and an opened forward face, female latch members secured to the upper edge of the container, the container having a depth of between 2 to 6 inches, two inclined shelves positioned between the sidewalls of the container, with the shelves being inclined in a direction towards the rearward face of the container, one horizontal shelf positioned between the sidewalls of the container, a series of dowels positioned along the horizontal shelf;

rolls of wrapping paper positioned upon the two inclined shelves of the container, a series of ribbon rolls secured over the series of dowels upon the horizontal shelf;

a frame having front and rear faces, an upper and lower edges and peripheral edges therebetween, hinges pivotally interconnecting the lower edge of the frame to the lower edge of the container, a series of clasps secured to the rear face of the frame, two opposing lengths of chain, each length of chain interconnected between a peripheral sidewall of the container and a peripheral edge of the frame, the opposing lengths of chain functioning to limit movement of the frame relative to the container, male latch members secured to the upper edge of the frame, the frame having a closed orientation wherein the male and female latch members are coupled to one another and wherein the frame is overlying the opened forward face of the container, the frame also having opened orientation wherein the frame is at a 90-degree angle relative to the wall mounted container;

a decorative picture and a rigid backing removably positioned within the picture frame such that the picture is visible through the front face of the frame, the series of clasps functioning to secure the picture and backing within the picture frame, such that when the frame is in its closed orientation the wall mounted container is hidden and the picture and frame are visible and wherein when the frame is in its opened orientation the contents of the container are readily accessible and the rigid backing forms a work surface for wrapping gifts.

* * * * *